US005692449A

United States Patent [19]

Meier

[11] Patent Number: 5,692,449

[45] Date of Patent: Dec. 2, 1997

[54] SEWING MACHINE WITH A DRIVE MECHANISM FOR A FABRIC HOLDER, E.G., AN EMBROIDERY FRAME

[75] Inventor: Willi Meier, Karlsruhe, Germany

[73] Assignee: G.M. Pfaff Aktiengesellschaft, Kaiserslautern, Germany

[21] Appl. No.: 704,000

[22] Filed: Aug. 28, 1996

[30] Foreign Application Priority Data

Sep. 6, 1995 [DE] Germany ..... 29 51 4286 U

[51] Int. Cl.[6] ..... D05B 21/00

[52] U.S. Cl. ..... 112/470.18

[58] Field of Search ..... 112/470.18, 103, 112/102.5, 470.06, 470.14, 220, 102

[56] References Cited

U.S. PATENT DOCUMENTS 5,040,474 8/1991 Kamijyo .

5,127,348 7/1992 Scholl et al. ..... 112/470.18

5,249,537 10/1993 Sakakibara ..... 112/470.18 X

*Primary Examiner*—Peter Nerbun

*Attorney, Agent, or Firm*—McGlew And Tuttle

[57] ABSTRACT

A sewing machine with a drive mechanism for a fabric holder is provided with a first carriage and a second carriage, the second carriage being connectable to the fabric holder. A first motor is provided for driving the first carriage via a first toothed belt and a second motor is provided for driving said second carriage via a second toothed belt, the second toothed belt forming part of a toothed belt drive. A first, stationary rail is provided extending in parallel to the longitudinal axis of the sewing machine, the first carriage being arranged on the first, stationary rail. A second rail is provided forming a transversely extending rail which is carried by the first carriage and extends at right angles to the longitudinal axis of the sewing machine, the second carriage being on the second rail, and the second rail forming a support for the toothed belt drive.

8 Claims, 2 Drawing Sheets

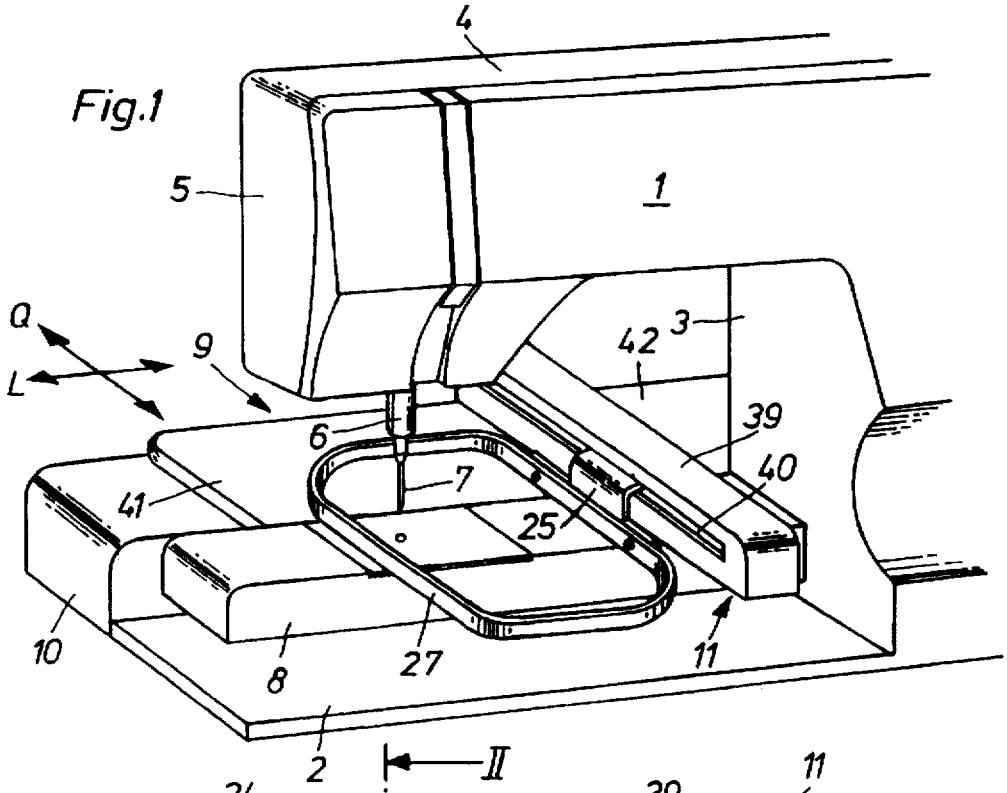
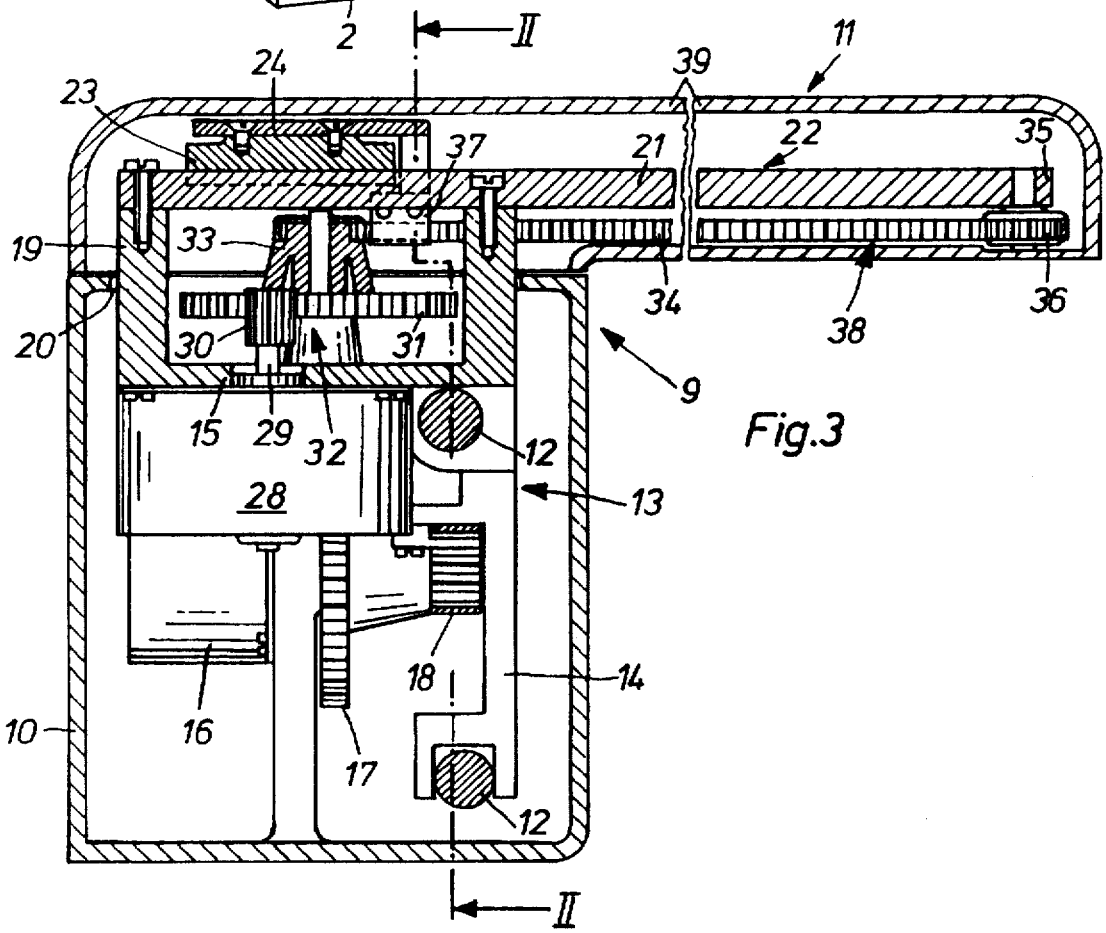
Fig.3

SEWING MACHINE WITH A DRIVE MECHANISM FOR A FABRIC HOLDER, E.G., AN EMBROIDERY FRAME

FIELD OF THE INVENTION

The present invention pertains to a sewing machine with a drive mechanism for a fabric holder with a first and second carriage, which are each driven by a separate motor and a toothed belt drive, wherein the first carriage is arranged on a first, stationary rail extending in parallel to the longitudinal axis of the sewing machine, and the second carriage, which can be connected to the fabric holder, is arranged on a second rail, which is carried by the first carriage and extends at right angles to the longitudinal axis of the sewing machine.

BACKGROUND OF THE INVENTION

A drive mechanism know from U.S. Pat. No. 5,040,474 for an emboroidery frame used on a sewing machine has a first carriage, which is movable on a rail which is rigidly connected to a housing and extends in parallel to the longitudinal axis of the sewing machine, and a second carriage movable on a second rail, wherein the second rail is fastened to the first carriage and extends at right angles to the fist rail. A bracket for a laterally extending embroidery frame is arranged on the second carriage. The drive motor associated with the first carriage is arranged rigidly connected to the housing and it drives this carriage via a toothed belt extending laterally from the first rail. The drive motor asscociated with the second carriage is arranged on the fist carriage and it also drives the second carriage via a toothed belt, which extends in the same manner as the other toothed belt, laterally from the rail associated with it, namely, at right angles to the longitudinal axis of the sewing machine. The second rail and the toothed belt adjacent to it are arranged in an extension arm, which, originating from the rear longitudinal side of the sewing machine, extends just above the support surface of the base plate of the machine. Due to the two rails and the corresponding toothed belt being arranged next to each other, with the strand of belt located closer also having a considerable distance from the rail, a flat, but relatively broad design of the extension arm is obtained, as a result of which its free space of movement between the needle bar or the sewing foot and the column of the machine housing is limited.

SUMMARY AND OBJECTS OF THE INVENTION

The primary object of the present invention is to provide a drive mechanism for a fabric holder, e.g., an embroidery frame, whose extension arm has a relatively small cross section along with high stability.

According to the invention a sewing machine with a drive mechanism for a fabric holder is provided with a first and a second carriage. Each of the carriages is driven by a separate motor and a toothed belt drive, wherein the first carriage is arranged on a first, stationary rail extending in parallel to the longitudinal axis of the sewing machine, and the second carriage, which can be connected to the fabric holder, is arranged on a second rail. The second rail is carried by the first carriage and extends at right angles to the longitudinal axis of the sewing machine. The rail which extends transversely is used directly as a support for the toothed belt drive associated with it.

Due to the measure of using the transversely extending rail directly as a support for the associated toothed belt drive, the latter can be arranged at a closely spaced location from the rail, so that the extension arm of the drive mechanism accommodating the rail and the toothed belt drive can have a relatively narrow design.

This also leads to a simplified design inasmuch as the rail, which is present anyway, can be used for holding the toothed belt drive and no additional components are needed.

An optimal design is obtained with a deflecting roller of the toothed belt drive mounted in the area of a free end of the said transversely extending rail, and the toothed belt arranged at a closely spaced location from the underside of the rail.

The transversely extending rail and its carriage are preferably formed by a linear guide with a recirculating ball carriage. The deflecting roller of the toothed belt drive is preferably mounted on the underside of the linear guide rail in the area of its free end. Since linear guides with recirculating ball are commercially available components, the design of the extension arm can thus be made especially simple, and a compact, space-saving design can be obtained.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a graphic representation of a sewing machine with an embroidery unit attached to it;

FIG. 3 is a sectional view extending in the transverse direction along line III—III according to FIG. 2.

DETAILED DESCRIPTION OF THE PREFERRED EMBODIMENT

Figure 2:
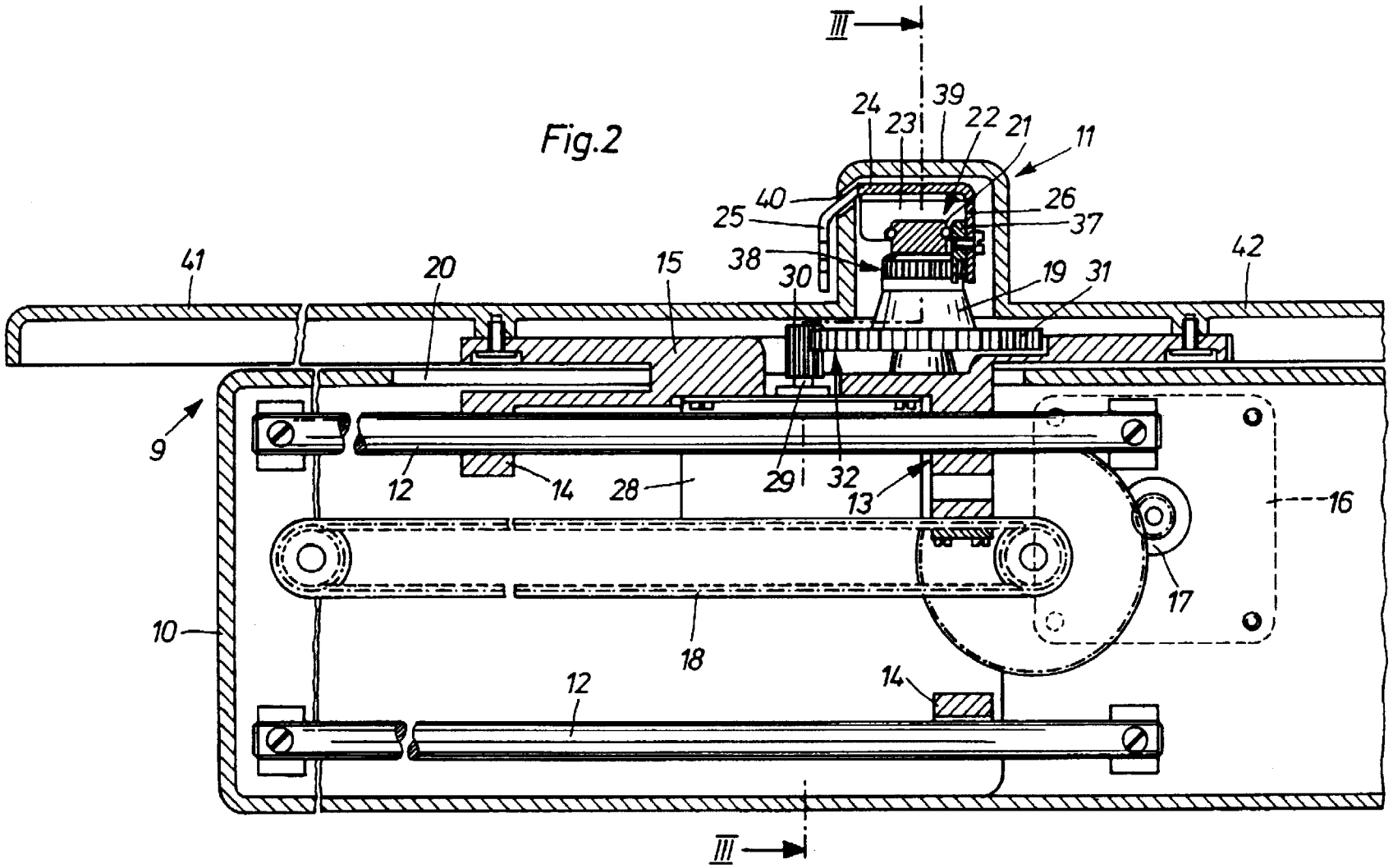
FIG. 2 is a sectional view of the embroidery unit in the longitudinal direction along line II—II according to FIG. 3 below.

Referring to the drawings in particular, the invention comprises a sewing machine with a drive mechanism for a fabric holder (an embroidery frame). Only part of the base plate 2, of the column 3, and of the arm 4 of the sewing machine 1, shown in FIG. 1 are shown. The arm 4 ends in a head 5, which carries a needle bar moving up and down in the known manner with a sewing needle 7. A horizontally extending bracket 8, which is located at a spaced location from the base plate 2, is arranged at the column 3. A shuttle, not shown in this case, which cooperates with the thread-carrying sewing needle 7 in the known manner to form a thread seam, is arranged in the bracket 8 as usual.

An embroidery unit 9 is detachably fastened on the rear longitudinal side of the bracket 8. The embroidery unit 9 has a housing 10, which extends in the longitudinal direction L and is in contact with the bracket 8, and an extension arm 11, which extends in the transverse direction Q at a short distance from the bracket 8 and is displaceable in the longitudinal direction L. A carriage 13, which is composed essentially of an L-shaped guide part 14 mounted on rail means comprising two guide rails 12 and a flat, T-shaped bracket 15, is arranged for this purpose in the housing 10 on two guide rods 12 extending in the longitudinal direction L.

A stepping motor 16, which is fastened to the housing 10 and is in drive connection with the guide part 14 of the carriage 13 via a reducing gear 17 and a toothed belt drive 18, is used including a toothed belt to drive the carriage 13.

A guide rail means comprising a guide rail of a linear drive 22, which guide rail 21 is an essential part of the extension arm 11, is fastened to a U-shaped section 19 of the bracket 15, which partly projects above the housing 10 through an opening 20 in the housing 10. The recirculating ball carriage 23 of the linear drive 22 is mounted on the guide rail 21. An inverted U-shaped support 24, which has two downwardly extending legs 25 and 26, is screwed tightly onto the top side of the carriage 23.

The leg 25 of the support 24 corresponds to the support plate 6 in DE 295 08 373 U1, which pertains to a holding device for embroidery frames. This leg is consequently used to hold the embroidery frame 27 shown in FIG. 1. The design of the holding device used here corresponds to that of the holding device disclosed in DE 295 08 373 U1, so that it does not need to be explained in greater detail.

A stepping motor 28 fastened to the carriage 13 is used to drive the carriage 23. A pinion 30 fastened to the motor shaft 29 forms a reducing gear 32 with a gear 31 mounted on the carriage 13. The gear 31 is connected in one piece to a toothed belt gear 33. The toothed belt gear 33 drives a toothed belt 34, which is arranged just under the guide rail 21 and is guided around a deflecting roller mounted in the area of the free end 35 of the guide rail 21. The toothed belt 34 is fixed on the leg 26 of the support 24 by means of a clamping plate 37, as a result of which the drive movements of the stepping motor 28 are transmitted to the carriage 23 and the latter is thus moved along on the guide rail 21. The toothed belt gear 33, the toothed belt 34, and the deflecting roller 36 form together a toothed belt drive 38.

The linear guide 22 and the toothed belt drive 38 are surrounded by a cover 39, which has a slot 40 for the passage of the leg 25 of the support 24. The cover 39 is connected in one piece to a left and right cover plate 41, 42 each, which are fastened to the bracket 15 of the carriage 13 and extend just above the housing 10. The dimensions of the cover plates 41, 42 are selected to be such that they cover the opening 20 of the housing 10 in each position of the carriage 13.

While a specific embodiment of the invention has been shown and described in detail to illustrate the application of the principles of the invention, it will be understood that the invention may be embodied otherwise without departing from such principles.

What is claimed is:

1. A sewing machine with a drive mechanism for a fabric holder, comprising:

a first carriage and a second carriage, said second carriage being connectable to the fabric holder;

a first motor driving said first carriage via a first toothed belt and a second motor driving said second carriage via a second toothed belt, said second toothed belt forming part of a toothed belt drive;

a first, stationary rail means extending in parallel to the longitudinal axis of the sewing machine, said first carriage being mounted on said first, stationary rail means;

a second rail means comprising a transversely extending rail which is carried by said first carriage and extends at right angles to the longitudinal axis of the sewing machine, said second carriage being on said second rail means, said second means directly supporting said toothed belt drive.

2. A sewing machine in accordance with claim 1, wherein said toothed belt drive includes a deflecting roller mounted in an area of a free end of said transversely extending rail, and said second toothed belt is arranged at a closely spaced location from an underside of said transversely extending rail.

3. A sewing machine in accordance with claim 1 wherein said transversely extending rail and said second carriage are formed by a linear guide with a recirculating ball carriage.

4. A sewing machine with a drive mechanism for a fabric holder, comprising:

a first carriage and a second carriage, said second carriage being connectable to the fabric holder;

a first, stationary rail means extending in parallel to the longitudinal axis of the sewing machine, said first carriage being mounted on said first, stationary rail means;

first carriage drive means for moving said first carriage along said first, stationary rail;

a second carriage drive motor;

a toothed belt drive including a toothed belt, said second carriage drive motor motor driving said second carriage via said toothed belt;

a second rail means comprising transversely extending rail which is carried exclusively by said first carriage and extends at right angles to the longitudinal axis of the sewing machine, said second carriage being disposed on said second rail means said second rail means forming a support for said toothed belt drive, said toothed belt drive including a deflecting roller mounted directly and exclusively to an area of a free end of said transversely extending rail, and said second toothed belt being arranged at a closely spaced location from an underside of said transversely extending rail.

5. A sewing machine with a drive mechanism for a fabric holder, comprising:

a first carriage and a second carriage, said second carriage being connectable to the fabric holder;

a first, stationary rail means extending in parallel to the longitudinal axis of the sewing machine, said first carriage being mounted on said first, stationary rail means first carriage drive means for moving said first carriage along said first, stationary rail;

a second carriage drive motor;

a toothed belt drive including a toothed belt, said second carriage drive motor motor driving said second carriage via said toothed belt;

a second rail means comprising transversly extending rail which is carried exclusively by said first carriage and extends from said first carriage in a freely projecting manner to provide a free end, at right angles to the longitudinal axis of the sewing machine, said second carriage being disposed on said second rail means, said second rail means forming a support for said toothed belt drive, said toothed belt drive including a deflecting roller mounted directly and exclusively to an area of said free end of said transversely extending rail, and said second toothed belt being arranged at a closely spaced location from an underside of said transversely extending rail.

6. A sewing machine in accordance with claim 4 wherein said transversely extending rail and said second carriage are formed by a linear guide with a recirculating ball carriage.

7. A sewing machine in accordance with claim 5 wherein said transversely extending rail and said second carriage are formed by a linear guide with a recirculating ball carriage.

8. A sewing machine in accordance with claim 1 wherein said transversely extending rail is supported exclusively by said first carriage and said toothed belt drive includes a deflecting roller supported by said rail means, disposed vertically below said rail means.

* * * * *